US006395105B1

(12) United States Patent
Wichelhaus et al.

(10) Patent No.: US 6,395,105 B1
(45) **Date of Patent: *May 28, 2002**

(54) PHOSPHATING PROCESS WITH A METALLIFEROUS RE-RINSING STAGE

(75) Inventors: Winfried Wichelhaus, Mettmann; Helmut Endres, Langenfeld; Karl-Heinz Gottwald, Erftstadt; Horst-Dieter Speckmann, Langenfeld; Jan-Willem Brouwer, Willich, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/617,886

(22) Filed: Jul. 17, 2000

Related U.S. Application Data

(63) Continuation of application No. 08/930,565, filed as application No. PCT/EP96/01196 on Mar. 20, 1996, now Pat. No. 6,090,224.

(30) Foreign Application Priority Data

Mar. 29, 1995 (DE) ..... 195 11 573

(51) Int. Cl.[7] ..... C23C 22/07

(52) U.S. Cl. ..... 148/253; 148/256; 148/260; 148/261; 148/259; 148/262; 148/263; 148/273; 148/275; 106/14.12

(58) Field of Search ..... 148/247, 253, 148/256, 260, 259, 261, 262, 263, 273, 275; 106/14.12

(56) References Cited

U.S. PATENT DOCUMENTS

| | | | | | |
|---|---|---|---|---|---|
| 4,600,447 | A | * | 7/1986 | Opitz et al. | 148/247 |
| 5,268,041 | A | * | 12/1993 | Gehmecker et al. | 148/260 |
| 6,090,224 | A | * | 7/2000 | Wichelhaus et al. | 148/256 |

* cited by examiner

*Primary Examiner*—John Sheehan
*Assistant Examiner*—Andrew L. Oltmans
(74) *Attorney, Agent, or Firm*—Stephen D. Harper

(57) ABSTRACT

A process for phosphating metal surfaces in which a nitrite- and nickel-free zinc-containing phosphating solution is applied to the metal surfaces which, if desired, are then rinsed and subsequently after-rinsed with an aqueous solution with a pH value of 3 to 7 which contains 0.001 to 10 g/l of one or more of the cations of Li, Cu and Ag.

20 Claims, No Drawings

PHOSPHATING PROCESS WITH A METALLIFEROUS RE-RINSING STAGE

CROSS-REFERENCE TO RELATED APPLICATION

This application is a continuation of application Ser. No. 08/930,565 filed Sep. 29, 1997 now U.S. Pat. No. 6,040,224 as the U.S. National Stage of International Application PCT EP96/01196 filed Mar. 20, 1996.

FIELD OF THE INVENTION

This invention relates to a process for phosphating metal surfaces with aqueous acidic zinc-containing phosphating solutions. To improve protection against corrosion and paint adhesion, the phosphating step is followed by an after-rinse using a solution containing lithium, copper and/or silver ions. The process is suitable as a pretreatment of the metal surfaces for subsequent painting, more especially by electrocoating. The process may be used for the treatment of surfaces of steel, galvanized or alloy-galvanized steel, aluminum, aluminized or alloy-aluminized steel.

TECHNICAL BACKGROUND AND RELATED ART

The object of phosphating metals is to produce on the surface of the metals firmly intergrown metal phosphate coatings which, on their own, improve resistance to corrosion and, in combination with lacquers and other organic coatings, contribute towards significantly increasing paint adhesion and resistance to creepage on exposure to corrosive influences. Phosphating processes have been known for some time. Low-zinc phosphating processes are particularly suitable for pretreatment before painting. The phosphating solutions used in low-zinc phosphating have comparatively low contents of zinc ions, for example of 0.5 to 2 g/l. A key parameter in low-zinc phosphating baths is the ratio by weight of phosphate ions to zinc ions which is normally >8 and may assume values of up to 30.

It has been found that phosphate coatings with distinctly improved corrosion-inhibiting and paint adhesion properties can be obtained by using other polyvalent cations in the zinc phosphating baths. For example, low-zinc processes with additions of, for example, 0.5 to 1.5 g/l of manganese ions and, for example, 0.3 to 2.0 g/l of nickel ions are widely used as so-called trication processes for preparing metal surfaces for painting, for example for the cathodic electrocoating of car bodies.

Unfortunately, the high content of nickel ions in the phosphating solutions of trication processes and the high content of nickel and nickel compounds in the phosphate coatings formed give rise to disadvantages insofar as nickel and nickel compounds are classified as critical from the point of view of pollution control and hygiene in the workplace. Accordingly, low-zinc phosphating processes which, without using nickel, lead to phosphate coatings comparable in quality with those obtained by nickel-containing processes have been described to an increasing extent in recent years. The accelerators nitrite and nitrate have also encountered increasing criticism on account of the possible formation of nitrous gases. In addition, it has been found that the phosphating of galvanized steel with nickel-free phosphating baths leads to inadequate protection against corrosion and to inadequate paint adhesion if the phosphating baths contain relatively large quantities (>0.5 g/l) of nitrate.

For example, DE-A-39 20 296 describes a nickel-free phosphating process which uses magnesium ions in addition to zinc and manganese ions. In addition to 0.2 to 10 g/l of nitrate ions, the corresponding phosphating baths contain other oxidizing agents, selected from nitrite, chlorate or an organic oxidizing agent, acting as accelerators. EP-A-60 716 discloses low-zinc phosphating baths which contain zinc and manganese as essential cations and which may contain nickel as an optional constituent. The necessary accelerator is preferably selected from nitrite, m-nitrobenzene sulfonate or hydrogen peroxide. EP-A-228 151 also describes phosphating baths containing zinc and manganese as essential cations. The phosphating accelerator is selected from nitrite, nitrate, hydrogen peroxide, m-nitrobenzoate or p-nitrophenol.

German Patent Application P 43 41 041.2 describes a process for phosphating metal surfaces with aqueous acidic phosphating solutions containing zinc, manganese and phosphate ions and, as accelerator, m-nitrobenzene sulfonic acid or water-soluble salts thereof, in which the metal surfaces are contacted with a phosphating solution which is free from nickel, cobalt, copper, nitrite and oxo anions of halogens and which contains 0.3 to 2 g/l of Zn(II), 0.3 to 4 g/l of Mn(II), 5 to 40 g/l of phosphate ions, 0.2 to 2 g/l of m-nitrobenzene sulfonate and 0.2 to 2 g/l of nitrate ions. A similar process is described in DE-A43 30 104, but uses 0.1 to 5 g of hydroxylamine instead of nitrobenzene sulfonate as accelerator.

Depending on the composition of the phosphating solution used, the method by which the phosphating solution is applied to the metal surfaces and/or other process parameters, the phosphate coating on the metal surfaces is not entirely compact. Instead, it is left with more or less large pores of which the surface area is of the order of 0.5 to 2% of the phosphated surface area and which have to be closed by so-called "after-passivation" to rule out potential points of attack for corrosive influences on the metal surfaces. In addition, after-passivation improves the adhesion of a paint subsequently applied.

It has been known for some time that solutions containing chromium salts can be used for this purpose. In particular, the corrosion resistance of the coatings produced by phosphating is significantly improved by after-treatment of the surfaces with solutions containing chromium(VI). The improvement in corrosion prevention results primarily from the fact that the phosphate deposited on the metal surface is partly converted into a metal(II)/chromium spinel.

A major disadvantage of using solutions containing chromium salts is that they are highly toxic. In addition, unwanted bubble formation is more likely to be observed during the subsequent application of paints or other coating materials.

For this reason, many other possibilities have been proposed for the after-passivation of phosphated metal surfaces, including for example the use of zirconium salts (NL-PS 71 16 498), cerium salts (EP-A492 713), polymeric aluminum salts (WO 92/15724), oligo- or poly-phosphoric acid esters of inositol in conjunction with a water-soluble alkali metal or alkaline earth metal salt of these esters (DE-A-24 03 022) or even fluorides of various metals (DE-A-24 28 065).

An after-rinse solution containing Al, Zr and fluoride ions is known from EP-B-410 497. This solution may be regarded as a mixture of complex fluorides or even as a solution of aluminum hexafluorozirconate. The total quantity of these three ions is in the range from 0.1 to 2.0 g/l.

DE-A-21 00 497 relates to a process for the electrophoretic application of colors to iron-containing surfaces with a view to solving the problem of applying white or other light colors to the iron-containing surfaces without discoloration. This problem is solved by rinsing the surfaces—which may be phosphated beforehand—with copper-containing solutions. Copper concentrations of 0.1 to 10 g/l are proposed for this after-rinse solution. DE-A-34 00 339 also describes a copper-containing after-rinse solution for phosphated metal surfaces, copper contents of 0.01 to 10 g/l being established in the solution. The fact that these after-rinse solutions produce different results in conjunction with different phosphating processes was not taken into account.

Of the above-described processes for the after-rinsing of phosphate coatings—except for chromium-containing after-rinse solutions—only those which use solutions of complex fluorides of titanium and/or zirconium have been successful. In addition, organic reactive after-rinse solutions based on amine-substituted polyvinylphenols are used. In conjunction with a nickel-containing phosphating process, these chromium-free after-rinse solutions meet the stringent requirements which paint adhesion and corrosion prevention are expected to satisfy, for example, in the automotive industry. However, for environmental and works safety reasons, efforts are being made to introduce phosphating processes in which there is no need to use either nickel or chromium compounds in any of the treatment steps. Nickel-free phosphating processes in conjunction with a chromium-free after-rinse still do not reliably meet the paint adhesion and corrosion prevention requirements on all the bodywork materials used in the automotive industry. Accordingly, there is still a need for after-rinse solutions which, in conjunction with nickel- and nitrite-free phosphating and subsequent cathodic electrocoating, reliably meet the corrosion prevention and paint adhesion requirements for various substrate materials. The problem addressed by the present invention was to provide a corresponding process combination of a phosphating process optimized in terms of environmental and works safety and a particularly suitable chromium-free after-rinse before cathodic electrocoating.

BRIEF SUMMARY OF THE INVENTION

According to the invention, this problem has been solved by a process for phosphating surfaces of steel, galvanized steel and/or aluminum and/or of alloys of which at least 50% by weight consist of iron, zinc or aluminum, the surfaces in question being phosphated with a zinc-containing acidic phosphating solution and then rinsed with an after-rinse solution, characterized in that:

a) a nitrite- and nickel-free solution with a pH value of 2.7 to 3.6 which contains 0.3 to 3 g/l of Zn(II), 5 to 40 g/l of phosphate ions and at least one of the following accelerators: 0.2 to 2 g/l of m-nitrobenzene sulfonate ions, 0.1 to 10 g/l of hydroxylamine in free or bound form, 0.05 to 2 g/l of m-nitrobenzoate ions, 0.05 to 2 g/l of p-nitrophenol, 1 to 70 mg/l of hydrogen peroxide in free or bound form is used for phosphating, and, after phosphating, with or without intermediate rinsing with water, b) the surface thus phosphated is rinsed with an aqueous solution with a pH value of 3 to 7 which contains 0.001 to 10 g/l of one or more of the following cations: lithium ions, copper ions and/or silver ions.

DETAILED DESCRIPTION OF THE INVENTION

The phosphating solution used in step a) of the sequence of process steps according to the invention preferably contains one or more other metal ions known in the prior art for their positive effect on the anti-corrosion behavior of zinc phosphate coatings. The phosphating solution may contain one or more of the following cations: 0.2 to 4 g/l of manganese(II), 0.2 to 2.5 g/l of magnesium(II), 0.2 to 2.5 g/l of calcium(II), 0.01 to 0.5 g/l of iron(II), 0.2 to 1.5 g/l of lithium(I), 0.02 to 0.8 g/l of tungsten(VI), 0.001 to 0.03 g/l of copper(II).

The presence of manganese and/or lithium is particularly preferred. The possibility of divalent iron being present depends upon the accelerator system described hereinafter. The presence of iron(II) in a concentration within the range mentioned pre-supposes an accelerator which does not have an oxidizing effect on these ions. Hydroxylamine in particular is mentioned as an example of such an accelerator.

The phosphating baths are free from nickel and preferably from cobalt. This means that these elements or ions are not intentionally added to the phosphating baths. In practice, however, such constituents cannot be prevented from entering the phosphating baths in traces through the material to be treated. In particular, it is not always possible in the phosphating of steel coated with zinc/nickel alloys to prevent nickel ions being introduced into the phosphating solution. However, the phosphating baths are expected to have nickel concentrations under technical conditions of less than 0.01 g/l and, more particularly, less than 0.0001 g/l. In a preferred embodiment, the phosphating baths also contain no oxo anions of halogens.

As described in EP-A-321 059, the presence of soluble compounds of hexavalent tungsten in the phosphating bath in the sequence of process steps according to the invention also affords advantages in regard to corrosion resistance and paint adhesion. Phosphating solutions containing 20 to 800 mg/l and preferably 50 to 600 mg/l of tungsten in the form of water-soluble tungstates, silicotungstates and/or borotungstates may be used in the phosphating process according to the invention. The anions mentioned may be used in the form of their acids and/or their water-soluble salts, preferably ammonium salts. The use of Cu(II) is known from EP-A-459 541.

In the case of phosphating baths which are intended to be suitable for various substrates, it has become standard practice to add free and/or complex fluoride in quantities of up to 2.5 g/l of total fluoride, including up to 800 mg/l of free fluoride. The presence of fluoride in quantities of this order is also of advantage to the phosphating baths according to the present invention. In the absence of fluoride, the aluminum content of the bath should not exceed 3 mg/l. In the presence of fluoride, higher Al contents are tolerated through complexing, providing the concentration of the non-complexed Al does not exceed 3 mg/l. Accordingly, it is of advantage to use fluoride-containing baths if the surfaces to be phosphated consist at least partly of or contain aluminum. In cases such as these, it is favorable to use only free rather than complexed fluoride, preferably in concentrations of 0.5 to 1.0 g/l.

For the phosphating of zinc surfaces, the phosphating baths do not necessarily have to contain so-called accelerators. For the phosphating of steel surfaces, however, the phosphating solution has to contain one or more accelerators. Corresponding accelerators are well known in the prior art as components of zinc phosphating baths. They are understood to be substances which chemically bind the hydrogen formed by the corrosive effect of the acid on the metal surface by being reduced themselves. In addition, oxidizing accelerators have the effect of oxidizing to the trivalent stage iron(II) ions, which are released by the corrosive effect on steel surfaces, so that the iron(III) ions can be precipitated as iron(III) phosphate. The accelerators suitable for use in the phosphating bath of the process according to the invention were mentioned earlier on.

In addition, nitrate ions may be present as co-accelerators in quantities of up to 10 g/l. This can have a favorable effect, especially in the phosphating of steel surfaces. In the phosphating of galvanized steel, however, the phosphating solution preferably contains very little nitrate. Nitrate concentrations of 0.5 g/l should preferably not be exceeded because, with higher nitrate concentrations, there is a danger of so-called "stippling" formation. Stippling means white crater-like defects in the phosphate coating.

From the point of view of ecological compatibility, hydrogen peroxide is the particularly preferred accelerator whereas, for technical reasons (simplified formulation of regeneration solutions), hydroxylamine is the particularly preferred accelerator. However, it is not advisable to use these two accelerators together, because hydroxylamine is decomposed by hydrogen peroxide. If hydrogen peroxide in free or bound form is used as the accelerator, concentrations of 0.005 to 0.02 g/l of hydrogen peroxide are particularly preferred. The hydrogen peroxide may be added to the phosphating solution as such. However, the hydrogen peroxide may also be used in bound form in the form of compounds which yield hydrogen peroxide in the phosphating bath through hydrolysis reactions. Examples of such compounds are persalts, such as perborates, percarbonates, peroxosulfates or peroxodisulfates. Ionic peroxides, such as alkali metal peroxides for example, are suitable as additional hydrogen peroxide sources.

Hydroxylamine may be used in the form of the free base, as a hydroxylamine complex or in the form of hydroxylammonium salts. If free hydroxylamine is added to the phosphating bath or to a phosphating bath concentrate, it will largely be present in the form of hydroxylammonium cation in view of the acidic character of these solutions. If the hydroxylamine is used in the form of a hydroxylammonium salt, the sulfates and phosphates are particularly suitable. In the case of the phosphates, the acidic salts are preferred by virtue of their better solubility. Hydroxylamine or its compounds are added to the phosphating bath in such quantities that the calculated concentration of free hydroxylamine is between 0.1 and 10 g/l, preferably between 0.2 and 6 g/l and more preferably between 0.3 and 2 g/l. It is known from EP-B-315 059 that the use of hydroxylamine as accelerator on iron surfaces leads to particularly favorable spherical and/or columnar phosphate crystals. The after-rinse to be carried out in step b) is particularly suitable for the after-passivation of such phosphate coatings.

Where lithium-containing phosphating baths are used, the preferred concentrations of lithium ions are in the range from 0.4 to 1 g/l. Phosphating baths containing lithium as sole monovalent cation are particularly preferred. Depending on the required ratio of phosphate ions to the divalent cations and the lithium ions, however, it may be necessary to add other basic substances to the phosphating baths in order to establish the desired free acid content. In this case, ammonia is preferably used so that the lithium-containing phosphating baths additionally contain ammonium ions in quantities of around 0.5 to around 2 g/l. In this case, the use of basic sodium compounds, such as sodium hydroxide for example, is less preferred because the presence of sodium ions in the lithium-containing phosphating baths adversely affects the corrosion-inhibiting properties of the coatings obtained. In the case of lithium-free phosphating baths, the free acid content is preferably established by addition of basic sodium compounds, such as sodium carbonate or sodium hydroxide.

Particularly good corrosion prevention results are obtained with phosphating baths which contain manganese (II) in addition to zinc and optionally lithium. The manganese content of the phosphating bath should be between 0.2 and 4 g/l because, with lower manganese contents, the positive effect on the corrosion behavior of the phosphate coating is lost whereas, with higher manganese contents, no further positive effect occurs. Contents of 0.3 to 2 g/l and, more particularly, contents of 0.5 to 1.5 g/l are preferred. The zinc content of the phosphating bath is preferably adjusted to a value of 0.45 to 2 g/l. However, due the corrosive effect in the phosphating of zinc-containing surfaces, the actual zinc content of the working bath may well increase to as high as 3 g/l. In principle, the form in which the zinc and manganese ions are introduced into the phosphating baths is not important. In particular, the oxides and/or carbonates may be used as the zinc and/or manganese source.

Where the phosphating process is applied to steel surfaces, iron passes into solution in the form of iron(II)ions. If the phosphating baths do not contain any substances with a highly oxidizing effect on iron(II), the divalent ion changes into the trivalent state, so that it can precipitate as iron(III) phosphate, primarily as a result of oxidation with air. Accordingly, iron(II) contents well above the contents present in baths containing oxidizing agents can build up in the phosphating baths. This is the case, for example, in the hydroxylamine-containing phosphating baths. In this sense, iron(II) concentrations of up to 50 ppm are normal; values of up to 500 ppm may even be briefly encountered in the production cycle. Iron(II) concentrations as high as these are not harmful to the phosphating process according to the invention.

The ratio by weight of phosphate ions to zinc ions in the phosphating baths may vary within wide limits, providing it remains between 3.7 and 30. A ratio by weight between 10 and 20 is particularly preferred. The entire phosphorus content of the phosphating bath is assumed to be present in the form of phosphate ions $PO_4^{3-}$ for this calculation. Accordingly, calculation of the quantity ratio disregards the known fact that, at the pH values of the phosphating baths which are normally in the range from about 3 to about 3.4, only a very small part of the phosphate is actually present in the form of the triply negatively charged anions. On the contrary, at these pH values, the phosphate can mainly be expected to be present in the form of the singly negatively charged dihydrogen phosphate anion, together with relatively small quantities of non-dissociated phosphoric acid and doubly negatively charged hydrogen phosphate anions.

The free acid and total acid contents are known to one skilled in the art as further parameters for controlling phosphating baths. The method used to determine these parameters in the present specification is described in the Examples. Free acid contents of 0 to 1.5 points and total acid contents of around 15 to around 30 points are normal and are suitable for the purposes of the invention.

Phosphating may be carried out by spraying, dipping or spraying/dipping. The contact times are in the usual range, i.e., between about 1 and about 4 minutes. The temperature of the phosphating solution is in the range from about 40 to about 60° C. Phosphating has to be preceded by the cleaning and activation steps typically applied in the prior art, preferably using activating baths containing titanium phosphate.

An intermediate rinse with water may be carried out between phosphating in step a) and after rinsing in step b). However, it is not necessary and there may even be advantages in omitting this intermediate rinse, because the after-rinse solution is then able to react with the phosphating solution still adhering to the phosphated surface; this favorably affects corrosion prevention.

The after-rinse solution used in step b) preferably has a pH value of 3.4 to 6 and a temperature in the range from 20 to 50° C. The concentrations of cations in the aqueous solution used in step b) are preferably in the following ranges: lithium(I) 0.02 to 2 and more particularly 0.2 to 1.5 g/l, copper(II) 0.002 to 1 g/l and more particularly 0.01 to 0.1 g/l, and silver(I) 0.002 to 1 g/l and more particularly 0.01 to 0.1 g/l. The metal ions mentioned may be present individually or in admixture with one another. After-rinse solutions containing copper(II) are particularly preferred.

In principle, the form in which the metal ions mentioned are introduced into the after-rinse solution is not important as long as it is guaranteed that the metal compounds are soluble in the above-mentioned concentration ranges of the metal ions. However, metal compounds containing anions which are known to promote the tendency towards corrosion, such as chloride for example, should be avoided. In a particularly preferred embodiment, the metal ions are used as nitrates or as carboxylates and, more particularly, as acetates. Phosphates are also suitable providing they are soluble under the concentration and pH conditions selected. The same applies to sulfates.

In one particular embodiment, the metal ions of lithium, copper and/or silver are used in the after-rinse solutions together with hexafluorotitanate ions and/or—in a particularly preferred embodiment—hexafluorozirconate ions. The concentrations of the anions mentioned are preferably in the range from 100 to 500 ppm. The source of the hexafluoroanions mentioned may be their acids or the salts thereof soluble in water under the concentration and pH conditions mentioned, more particularly their alkali metal and/or ammonium salts. In a particularly preferred embodiment, the hexafluoroanions are used at least partly in the form of their acids, and basic compounds of lithium, copper and/or silver are dissolved in the acidic solutions. For example, the hydroxides, oxides or carbonates of the metals mentioned are suitable for this purpose. By adopting this procedure, it is possible to avoid using the metals together with possibly troublesome anions. If necessary, the pH value may be adjusted with ammonia.

In addition, the after-rinse solutions may contain the ions of lithium, copper and/or silver together with ions of cerium (III) and/or cerium(IV), the total concentration of cerium ions being in the range from 0.01 to 1 g/l.

In addition, the after-rinse solution may contain aluminum(III) compounds in addition to the ions of lithium, copper and/or silver, the concentration of aluminum being in the range from 0.01 to 1 g/l. Particularly suitable aluminum compounds are, on the one hand, polyaluminum compounds, such as for example polymeric aluminum hydroxychloride or polymeric aluminum hydroxysulfate (WO 92/15724), or complex aluminum/zirconium fluorides of the type known, for example, from EP-B-410 497.

The metal surfaces phosphated in step a) may be contacted with the after-rinse solution in step b) by spraying, dipping or spraying/dipping, the contact time having to be between 0.5 and 10 minutes; it is preferably of the order of 40 to 120 seconds. By virtue of the simpler equipment required, it is preferred to spray the after-rinse solution in step b) onto the metal surface phosphated in step a).

In principle, the treatment solution does not have to be rinsed off after the contact time and before subsequent painting. For example, the metal surfaces phosphated in accordance with the invention in step a) and after-rinsed in step b) may be dried and painted, for example with a powder coating, without further rinsing. However, the process is particularly designed as a pretreatment before cathodic electrocoating. To avoid contamination of the paint bath, it is preferred to rinse the after-rinse solution off the metal surfaces following the after-rinse in step b), preferably using water that is low in salt content or deionized water. Before introduction into the electrocoating tanks, the metal surfaces pretreated in accordance with the invention may be dried. In the interests of a faster production cycle, however, the drying step is preferably omitted.

EXAMPLES

The sequence of process steps according to the invention was tested on steel plates of the type used in automobile construction. The following sequence of process steps typically applied in body assembly was carried out by immersion:

1. Cleaning with an alkaline cleaner (Ridoline® 1558, Henkel KGaA), 2% solution in process water, 55° C., 5 minutes.
2. Rinsing with process water, room temperature, 1 minute.
3. Activation with a liquid activator containing titanium phosphate by immersion (Fixodine® L, Henkel KGaA), 0.5% solution in deionized water, room temperature, 1 minute.
4. Step a): phosphating with phosphating baths according to Table 1 (prepared in fully deionized water). In addition to the cations mentioned in Table 1, the phosphating baths optionally contain sodium or ammonium ions to establish the free acid content. The baths did not contain any nitrite or any oxo anions of halogens. Temperature: 56° C., time: 3 minutes.

The free acid points count is understood to be the quantity of 0.1-normal sodium hydroxide in ml which is required to titrate 10 ml of bath solution to a pH value of 3.6. Similarly, the total acid points count indicates the consumption in ml to a pH value of 8.5.

5. Optionally (cf. Table 3) rinsing with process water, room temperature, 1 minute.
6. Step b): after-rinsing by spraying with a solution according to Table 2.
7. Rinsing with deionized water.

TABLE 1

PHOSPHATE BATHS AND COATING WEIGHTS

| Component | Com. 1 | Ex. 1 | Ex. 2 | Ex. 3 | Ex. 4 |
|---|---|---|---|---|---|
| Zn(II) (g/l): | 1.0 | 1.0 | 1.0 | 1.0 | 1.0 |
| Phosphate (g/l): | 14 | 14 | 14 | 14 | 14 |
| Li(I) (g/l): | — | — | — | — | 0.5 |
| Mn(II) (g/l): | 1.0 | 1.0 | 1.0 | 1.0 | 1.0 |
| Ni(II) (g/l): | 0.8 | — | — | — | — |
| $SiF_6^{2-}$ (g/l): | 0.96 | 0.96 | 0.96 | 0.96 | 0.96 |
| $F^-$ free (g/l): | 0.22 | 0.22 | 0.22 | 0.22 | 0.22 |
| $NH_2OH$ (g/l): | 0.66 | 0.66 | — | — | 0.66 |
| m-Nitrobenzene sulfonic acid (g/l): | — | — | 0.7 | — | — |
| $H_2O_2$ (mg/l): | — | — | — | 1.3 | — |
| pH value: | 3.4 | 3.4 | 3.2 | 3.4 | 3.4 |

TABLE 1-continued

PHOSPHATE BATHS AND COATING WEIGHTS

| Component | Com. 1 | Ex. 1 | Ex. 2 | Ex. 3 | Ex. 4 |
|---|---|---|---|---|---|
| Free acid (points): | 1.0 | 1.0 | 1.1 | 1.0 | 1.0 |
| Total acid (points): | 23 | 23 | 24 | 23 | 23 |
| Layer weight (g/m$^2$): | 2.3 | 2.1 | 2.2 | 1.9 | 2.0 |

TABLE 2

AFTER-RINSE SOLUTIONS AND PROCESS PARAMETERS. CONCENTRATIONS IN PPM.

| Component | Com.v | Com.w | Com.x | Ex.a | Ex.b | Ex.c | Ex.d | Ex.e | Ex.f | Ex.g |
|---|---|---|---|---|---|---|---|---|---|---|
| Li(I): | — | — | — | 800 | 400 | — | — | — | 400 | — |
| Cu(II): | — | — | — | — | — | 10 | 10 | 50 | 10 | 10 |
| Ag(I): | — | — | — | — | — | — | — | — | — | — |
| Ce(III): | — | 110 | — | — | — | — | — | — | — | — |
| Ce(IV): | — | 320 | — | — | — | — | — | — | — | — |
| Al(III): | — | — | 200 | — | — | — | — | — | — | 200 |
| $TiF_6^{2-}$: | — | — | — | — | — | — | — | — | — | — |
| $ZrF_6^{2-}$: | 250 | — | — | — | 250 | — | — | — | — | — |
| pH: | 4.0 | 4.2 | 3.8 | 4.0 | 4.0 | 3.6 | 3.6 | 3.6 | 3.8 | 3.8 |
| Bath Temperature (° C.): | 40 | 40 | 40 | 40 | 35 | 50 | 30 | 45 | 40 | 40 |
| Treatment Time (secs.) | 60 | 60 | 60 | 60 | 60 | 60 | 120 | 60 | 60 | 60 |

| Component | Ex.h | Ex.i | Ex.k | Ex.l | Ex.m | Ex.n |
|---|---|---|---|---|---|---|
| Li(I): | — | — | — | 400 | — | 500 |
| Cu(II): | 30 | 30 | — | — | — | — |
| Ag(I): | — | — | 30 | 30 | 20 | — |
| Ce(III): | — | — | — | — | — | 110 |
| Ce(IV): | — | — | — | — | — | 320 |
| Al(III): | — | — | — | — | — | — |
| $TiF_6^{2-}$: | 200 | — | — | — | — | — |
| $ZrF_6^{2-}$: | — | 250 | — | — | 200 | — |
| pH | 3.6 | 3.6 | 3.4 | 3.4 | 3.4 | 4.2 |
| Bath Temperature (° C.) | 40 | 40 | 40 | 40 | 40 | 40 |
| Treatment Time (secs.) | 60 | 60 | 30 | 60 | 60 | 60 |

8. Drying with compressed air for tests on unpainted plates, otherwise coating with a cathodic electrocoating paint in the moist state.

Current density/potential measurements were carried out as an accelerated test for determining the corrosion-preventing effect of the layers. This process is described, for example, in A. Losch, J. W. Schultze, D. Speckmann: "A New Electrochemical Method for the Determination of the Free Surface of Phosphate Layers", *Appl. Surf. Sci.* 52, 29–38 (1991). To this end, the phosphated test plates are clamped in unpainted form in a specimen holder of polyamide which leaves free a surface area to be studied of 43 cm$^2$. The measurements were carried out under oxygen-free conditions (purging with nitrogen) in an electrolyte of pH 7.1 which contained 0.32 M $H_3BO_3$, 0.026 M $Na_2B_4O_7 \cdot 10H_2O$ and 0.5 M $NaNO_3$. A standard mercury electrode with a normal potential $E_0$ of 0.68 volt was used as the reference electrode. The samples were first immersed in the electrolyte solution for 5 minutes without application of an external potential. Cyclic voltamograms were then recorded between −0.7 and 1.3 volts against the standard mercury electrode with a potential change of 20 mV/s. For evaluation, the current density was read off at a potential of −0.3 volt, based on the standard mercury electrode. Negative current densities at a potential of −0.3 volt show a reduction of coating constituents. High current densities indicate a poor barrier effect whereas low current densities indicate a good barrier effect of the phosphate coatings against corrosive currents.

TABLE 3

RESULTS OF CURRENT DENSITY MEASUREMENTS (MA/CM$^2$) AT POTENTIAL −0.3 v

| Phosphating Bath | With Intermediate Rinsing with Municipal Water | | | | | Without Intermediate Rinsing with Municipal Water | | | | |
|---|---|---|---|---|---|---|---|---|---|---|
| After-Rinse | Com.1 | Ex.1 | Ex.2 | Ex.3 | Ex.4 | Com.1 | Ex.1 | Ex.2 | Ex.3 | Ex.4 |
| Com.v | 0 | 25 | 28 | 30 | 15 | 5 | 30 | 35 | 35 | 21 |
| Com.w | 0 | 24 | 30 | 35 | 21 | — | — | — | — | — |
| Com.x | 0 | 18 | 25 | 22 | 16 | — | — | — | — | — |
| None | 5 | 28 | 35 | 42 | 20 | — | — | — | — | — |
| Ex.a | — | 2 | 8 | 5 | 10 | — | 0 | 0 | 2 | 5 |

TABLE 3-continued

RESULTS OF CURRENT DENSITY MEASUREMENTS ($MA/CM^2$) AT POTENTIAL −0.3 v

| Phosphating Bath | With Intermediate Rinsing with Municipal Water | | | | | Without Intermediate Rinsing with Municipal Water | | | | |
|---|---|---|---|---|---|---|---|---|---|---|
| After-Rinse | Com.1 | Ex.1 | Ex.2 | Ex.3 | Ex.4 | Com.1 | Ex.1 | Ex.2 | Ex.3 | Ex.4 |
| Ex.b | — | 6 | 4 | 2 | 0 | — | — | — | — | — |
| Ex.c | — | 10 | 12 | 13 | 4 | — | 0 | 5 | 3 | 0 |
| Ex.d | — | 0 | 0 | 3 | 0 | — | 0 | 0 | 0 | 0 |
| Ex.e | — | 0 | 0 | 0 | 0 | — | 0 | 0 | 0 | 0 |
| Ex.f | — | 0 | 0 | 0 | 0 | — | — | — | .— | — |
| Ex.g | — | 0 | 3 | 2 | 0 | — | 0 | 0 | 0 | 0 |
| Ex.h | — | 0 | 0 | 0 | 0 | — | — | — | — | — |
| Ex.i | — | 0 | 0 | 0 | 0 | — | — | — | — | — |
| Ex.k | — | 3 | 0 | 5 | 4 | — | 0 | 0 | 0 | 0 |
| Ex.l | — | 0 | 0 | 0 | 5 | — | — | — | — | — |
| Ex.m | — | 0 | 0 | 0 | 0 | — | — | — | — | — |
| Ex.n | — | 0 | 0 | 0 | 3 | — | — | — | — | — |

The coating weights were determined by weighing the phosphated plates, dissolving the phosphate coating in 0.5% by weight chromic acid solution and reweighing.

In the after-rinse solutions according to Table 2, Li was used as carbonate, Cu as acetate and Ag as sulfate, $TiF_6^{2-}$ and $ZrF_6^{2-}$ as free acids. Ce(III) was used as nitrate, Ce(IV) as sulfate and Al(III) as polyaluminum hydroxychloride with the approximate composition $Al(OH)_{2.5}Cl$. pH values were corrected downwards with phosphoric acid and upwards with ammonia solution.

For corrosion prevention tests, test plates of steel (St 1405) and electrogalvanized steel were dip-phosphated with a phosphating solution with the following bath parameters in the general sequence of process steps described above:

Zn 1.2 g/l
Mn 1.0 g/l
$PO_4^{3-}$ 14.6 g/l
Hydroxylammonium sulfate 1.8 g/l
$SiF_6^-$ 0.8 g/l
Free acid 0.7 points
Total acid 23.0 points
Bath temperature 50° C.
Treatment time 3 minutes After intermediate rinsing with municipal water for 1 minute at a temperature of 40° C., the test plates were immersed in the following after-rinse solution in deionized water (Table 4). The plates were then rinsed with deionized water, dried and painted.

TABLE 4

AFTER-RINSE SOLUTIONS

| | Com. y | Ex. p | Ex. q | Ex. r | Ex. s |
|---|---|---|---|---|---|
| $ZrF_6^{2-}$ (ppm) | 225 | — | — | 225 | 225 |
| $Cu^{2+}$ (ppm) | — | 10 | 50 | 10 | 50 |
| pH | 4.0 | 3.6 | 3.6 | 3.6 | 3.6 |

The cathodic electrocoating paint FT 85-7042 grey produced by BASF was used for painting. The corrosion prevention test was carried out by the "VDA-Wechselklimatest" (VDA Alternating Climate Test) 621-415. The paint creepage at the score line is shown as the test result in Table 5. In addition, a paint adhesion test was carried out by the "VW Steinschlagtest" (VW Chipping Test) which was evaluated according to the K value. Higher K values signify relatively poor paint adhesion while low K values signify better paint adhesion. Results are also set out in Table 5.

In addition, an outdoor weathering test was carried out in accordance with VDE 621-414. To this end, a full paint finish (VW white) was applied to the electrocoated test plates. After 6 months outdoors, the following paint creepage values (half the score width) were obtained (Table 6).

TABLE 5

CORROSION PREVENTION VALUES AND PAINT ADHESION CHARACTERISTICS

| After-Rinse | Paint Creepage (mm) | | K Value | |
|---|---|---|---|---|
| Solution | Steel | Galvanized Steel | Steel | Galvanized Steel |
| Deionized Water | 1.8 | 4–5 | 7–8 | 9 |
| Com. 4 | 1.3 | 3–4 | 6 | 8 |
| Ex. p | 1.2 | | 6 | |
| Ex. q | 1.0 | 2.5–3.5 | 6 | 8 |
| Ex. r | 1.2 | 2.1–3 | 6 | 8 |
| Ex. s | 1.1 | | 6 | |

TABLE 6

PAINT CREEPAGE (U/2, MM) AFTER OUTDOOR WEATHERING

| After-Rinse Solution | Steel | Galvanized Steel |
|---|---|---|
| Deionized Water | 1.8 | 0.1 |
| Com. 4 | 1.2 | 0.1 |
| Ex. p | 1.2 | 0.1 |
| Ex. q | 0.9 | 0.1 |
| Ex. r | 1.3 | |
| Ex. s | 1.0 | 0.1 |

What is claimed is:

1. A process for phosphating and after-rinsing a metallic surface of which at least 50% by weight consists of one or more of iron, zinc and aluminum, said process comprising operations of:

(a) phosphating the surface by contacting it with a nitrite- and nickel-free water-based phosphating solution which has a pH value of 2.7 to 3.6 and comprises: 0.3 to 3 g/l of Zn(II); 5 to 40 g/l of phosphate ions; and at least one of the following accelerators: 0.2 to 2 g/l of m-nitrobenzene sulfonate ions; 0.1 to 10 g/l of hydroxylamine in free or bound form; 0.05 to 2 g/l of m-nitrobenzoate ions; 0.05 to 2 g/l of p-nitrophenol; and 1 to 70 mg/l of hydrogen peroxide in free or bound form;

and, after phosphating, with or without intermediate rinsing with water, (b) rinsing the surface phosphated in step (a) with an aqueous solution with a pH value of 3 to 7 which contains 0.01 to 0.1 g/l of copper cations.

2. A process as claimed in claim 1, wherein the phosphating solution used in step (a) additionally contains one or more of the following cations: 0.2 to 4 g/l of manganese(II), 0.2 to 2.5 g/l of magnesium(II), 0.2 to 2.5 g/l of calcium(II), 0.01 to 0.5 g/l of iron(II), 0.2 to 1.5 g/l of lithium(I), 0.02 to 0.8 g/l of tungsten(VI), and 0.001 to 0.03 g/l of copper(II).

3. A process as claimed in claim 2, wherein the phosphating solution used in step (a) additionally contains up to 2.5 g/l of total fluoride, including up to 0.8 g/l of free fluoride.

4. A process as claimed in claim 3, wherein the after-rinse solution used in step (b) has a pH value of 3.4 to 6.

5. A process as claimed in claim 4, wherein the after-rinse solution used in step (b) has a temperature of 20 to 50° C.

6. A process as claimed in claim 5; wherein the after-rinse solution used in step (b) is sprayed onto the metal surface phosphated in step (a).

7. A process as claimed in claim 6, wherein the after-rinse solution used in step (b) is allowed to act on the phosphated metal surface for 0.5 to 10 minutes.

8. A process as claimed in claim 7, wherein no intermediate rinsing is carried out between steps (a) and (b).

9. A process as claimed in claim 1, wherein the phosphating solution used in step (a) additionally contains up to 2.5 g/l of total fluoride, including up to 0.8 g/l of free fluoride.

10. A process as claimed in claim 9, wherein the after-rinse solution used in step (b) has a pH value of 3.4 to 6.

11. A process as claimed in claim 10, wherein the after-rinse solution used in step (b) has a temperature of 20 to 50° C.

12. A process as claimed in claim 11, wherein no intermediate rinsing is carried out between steps (a) and (b).

13. A process as claimed in claim 12, wherein the after-rinse solution used in step (b) is allowed to act on the phosphated metal surface for 0.5 to 10 minutes.

14. A process as claimed in claim 1, wherein the after-rinse solution used in step (b) has a pH value of 3.4 to 6.

15. A process as claimed in claim 14, wherein the after-rinse solution used in step (b) has a temperature of 20 to 50° C.

16. A process as claimed in claim 15, wherein no intermediate rinsing is carried out between steps (a) and (b).

17. A process as claimed in claim 16, wherein the after-rinse solution used in step (b) is allowed to act on the phosphated metal surface for 0.5 to 10 minutes.

18. A process as claimed in claim 1, wherein the after-rinse solution used in step (b) has a temperature of 20 to 50° C.

19. A process as claimed in claim 18, wherein no intermediate rinsing is carried out between steps (a) and (b).

20. A process as claimed in claim 1, wherein no intermediate rinsing is carried out between steps (a) and (b).

* * * * *

UNITED STATES PATENT AND TRADEMARK OFFICE

CERTIFICATE OF CORRECTION

PATENT NO. : 6,395,105 B1
DATED : May 28, 2002
INVENTOR(S) : Wichelhaus et al.

It is certified that error appears in the above-identified patent and that said Letters Patent is hereby corrected as shown below:

Column 13,
Line 19, after "claim 5", delete ";", and insert therefor -- , --.

Signed and Sealed this

Twentieth Day of May, 2003

JAMES E. ROGAN
*Director of the United States Patent and Trademark Office*